US005393042A

United States Patent [19]

Coombs et al.

[11] Patent Number: 5,393,042

[45] Date of Patent: Feb. 28, 1995

[54] IN-BIN STAPLING SORTER WITH FLEXIBLE ALIGNMENT ARM

[75] Inventors: Peter M. Coombs, Tustin; James R. Seay, Dana Point, both of Calif.

[73] Assignee: Gradco (Japan) Ltd., Tokyo, Japan

[21] Appl. No.: 100,720

[22] Filed: Aug. 3, 1993

[51] Int. Cl.[6] ..... B31B 1/68; B65H 39/02; B65H 31/36

[52] U.S. Cl. ..... 270/53; 271/221; 270/58

[58] Field of Search ..... 270/53, 58; 271/221, 271/222, 293, 294

[56] References Cited

U.S. PATENT DOCUMENTS 3,107,088 10/1963 Syversen ..... 270/58
3,561,754 2/1971 Gaffron ..... 270/58 X
3,774,906 11/1973 Fagan et al. ..... 270/58 X
4,397,461 8/1983 Du Bois et al. ..... 271/293
5,193,801 3/1993 Coombs et al. ..... 271/293

*Primary Examiner*—Edward K. Look
*Assistant Examiner*—John Ryznic

[57] ABSTRACT

An in-bin stapling sorter has a stack of trays moved to positions above and below a sheet entry location at which the trays are spaced apart by cams to receive sheets of paper from an office copier or printer. Sets of sheets are stapled in the trays as the trays are moved together past a stapler which is moved into a stapling position from a non-stapling position. An aligning arm is disposed at one side of the set of trays to engage a side edge of the sheets fed into the trays and sets of sheets in the trays during stapling to align the side edges of the sets of sheets for moving the sheets and sets of sheets against a straight surface at the other side of the trays, thereby providing a neat stapled set.

8 Claims, 4 Drawing Sheets

IN-BIN STAPLING SORTER WITH FLEXIBLE ALIGNMENT ARM

BACKGROUND OF THE INVENTION

In-bin stapling sorters are well known wherein sets of sheets received in the sorter trays are automatically stapled by a stapler which is normally retracted during sorting operations and is moved to a stapling position to automatically apply one or more staples to the set of sheets in the trays.

In the collating of sheets of paper into sets of documents or in segregating sets of sheets in so called sorting machines, it is desired that the sheets forming the sets or documents be aligned or registered to provide a neat package, particularly when the set or document is to be bound or stapled.

In a variety of moving bin sorters, the trays are arranged in a stack of vertically spaced trays which extend horizontally but at an incline from the sheet entry end of the trays, so that the trailing edge of sheets tend to gravitate into alignment against a flange at the lower end of the trays as the sheets are fed into the trays. At the side of the sheets normal to the trailing edge, the sheets may not be closely registered, so that when the set is removed for binding or stapling, an operator may hand jog the sheets into registration in both directions.

Automatic joggers have evolved which are operated to laterally displace sheets in the sorting trays against a standard or vertical wall forming a part of the frame structure for the sorter or against a side flange on the trays. Such joggers have typically been mechanically operated and include a member moved laterally of the sorter trays to engage and move the sheets into engagement with the standard or side edge flange, as referred to above.

An example of such a jogger is illustrated in U.S. Pat. No. 4,928,941. In this construction, jogging of the sheets to provide neat, edge registered sets is important in that the sets are stapled while in the trays by a stapler moved to a stapling position as the trays containing the sets of sheets are successively moved to the stapler. In other sorters, as shown in U.S. Pat. No. 5,125,634, sets of sheets may be gripped in a set moving device which carries the clamped set to a stapler, so that edge alignment of sheets at the time when the set is gripped is important from the standpoint of stapling a neat set.

Such joggers have involved relatively complicated mechanisms and timing means to cause the jogging action in a sorter which otherwise, has been simplified and made of compact form due to the fact that the trays are sequentially opened to provide a large sheet entry space between trays, while otherwise the trays are close together.

Examples of such sorters, other than that shown in the above referenced patent No. 4,928,941, are the sorters shown in Lawrence U.S. Pat. Nos. 4,911,424 and 5,125,634. In the latter, the sets of sheets are finished or stapled in the trays, so that edge registration is more important than in the other examples in which edge registration is, nevertheless, important.

In U.S. patent application Ser. No. 889,633, filed May 28, 1992 co-owned herewith, the jogging of sheets is performed as in the case of patent No. 4,928,941 in that the sheets are moved laterally relative to the direction of infeed into the trays as the trays are moved up and down by the tray shifting mechanism. In this sorter, the tray shifting mechanism does not provide any additional space to accommodate the stapler body, either between trays or longitudinally of the trays, but, instead, the stapler body engages and displaces the sets longitudinally as successive sets of sheets are being stapled in the bins.

SUMMARY OF THE INVENTION

The present invention provides a very simple and inexpensive solution to automatically aligning the side edges of sheets received in the trays of moving tray sorters of the type wherein stapling is performed in the trays as the trays are moved to the in-bin stapling position.

More particularly, an aligning device is provided which automatically aligns the sheets in the trays of the moving tray sorter as the trays are moved, in a simple manner and without requiring actuation of a jogging rod or arm.

According to the present invention, an alignment member, preferably of flexible or resilient material, engages one side edge of the sheets to displace the sheets laterally towards a registration member at the opposite side of the trays which provides a straight vertical surface for registration of the other side edge, as the trays move up and/or down past an infeed location.

In addition, the sheets are finally guided into aligned relation between the alignment member and the registration member at the opposite side of the tray as a function of the trays being moved from an upper position above a stapler to a stapling position.

Other features and advantages of the invention will be hereinafter described or will become apparent from the following detailed description of the illustrative embodiment shown in the drawings forming a part of this application.

DESCRIPTION OF THE PREFERRED EMBODIMENT

Figure 1:
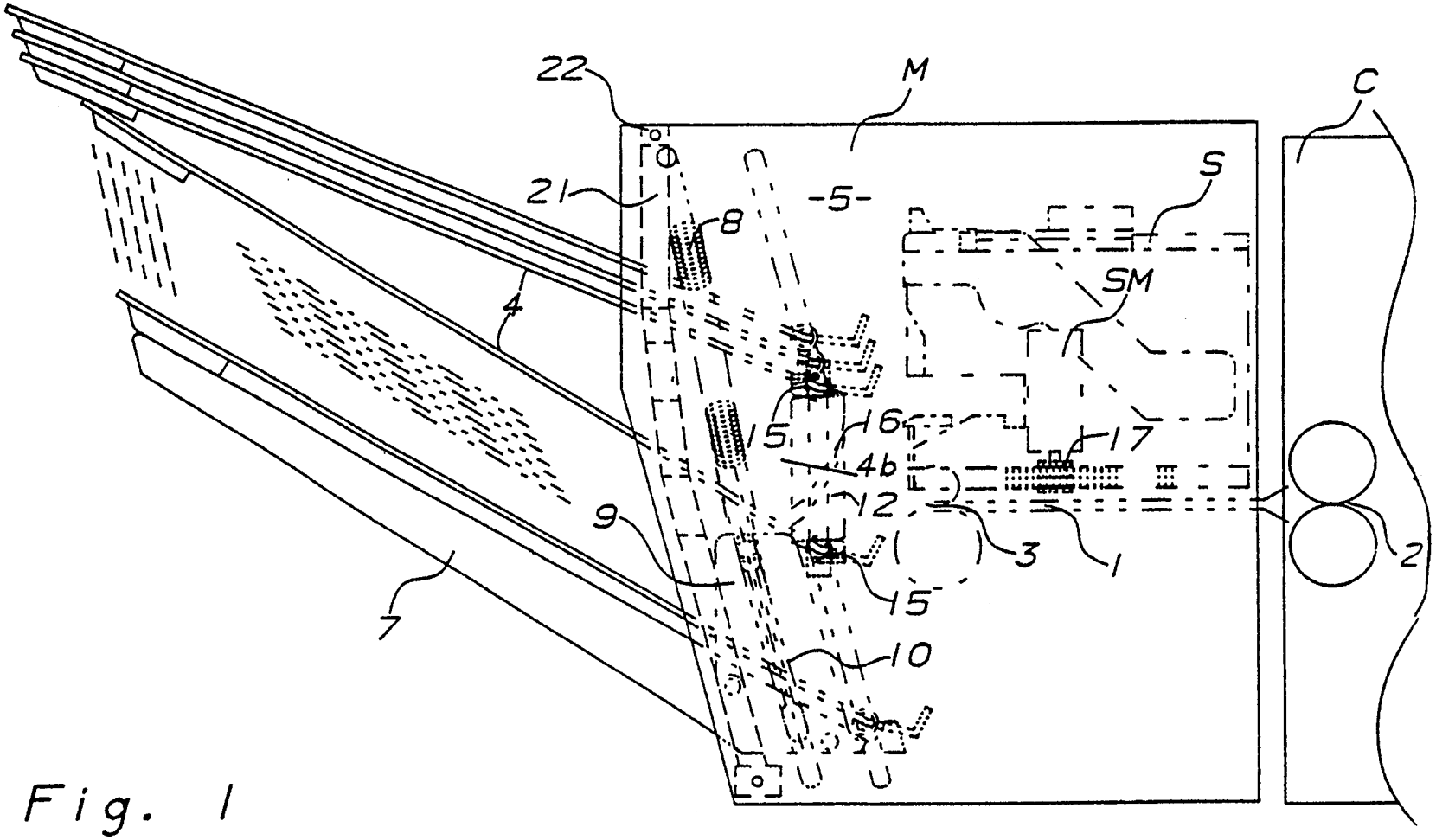
FIG. 1 is a side elevation showing an in-bin stapling sorter incorporating the invention.

As seen in the drawings, referring first to FIG. 1, a sorting machine M is positioned adjacent to a copying or printing machine C. Sheets of paper are fed through a feed path 1 from outlet feed rolls 2 of the copier to infeed rolls 3 of the sorter.

Such a sorter is more particularly disclosed in U.S. Pat. No. 5,225,902. A set of trays 4 are extended horizontally from the sorter housing 5 and pivotally and slidably rest one on the other at their outer ends 6, except that the outer end of the lower most tray 4 rests on a bottom tray support 7. Tray support 7 is adapted to move vertically and is biased upwardly at its inner end by a coiled spring 8 connected at its upper end to the housing and at its lower end to a lift frame 9 adapted to move vertically in a guide slot 10, as the inner ends 11 of the trays are caused to move vertically.

Vertical movements of the inner tray ends 11 are caused in response to rotation of a pair of spiral cams 12 rotatable with shafts 13 adapted to be driven in unison by a reversible drive motor DM and a transversely extended drive shaft 14. Each tray end 11 has a pair of trunnions 15 for engagement in a spiral cam track 16 for opposite movement of the tray ends 11 responsive to opposite rotation of cams 12.

Figure 2:
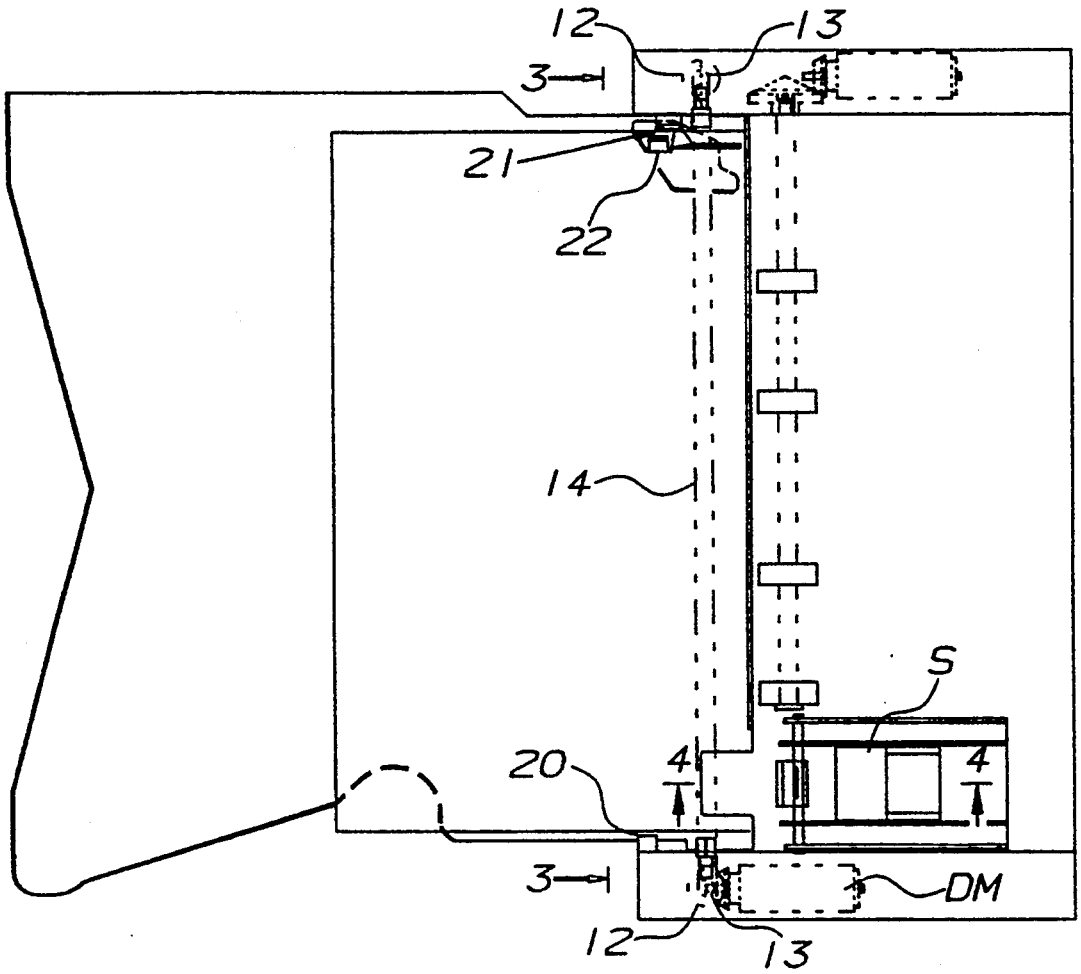
FIG. 2 is a top plan view with the cover removed.
Figure 4:
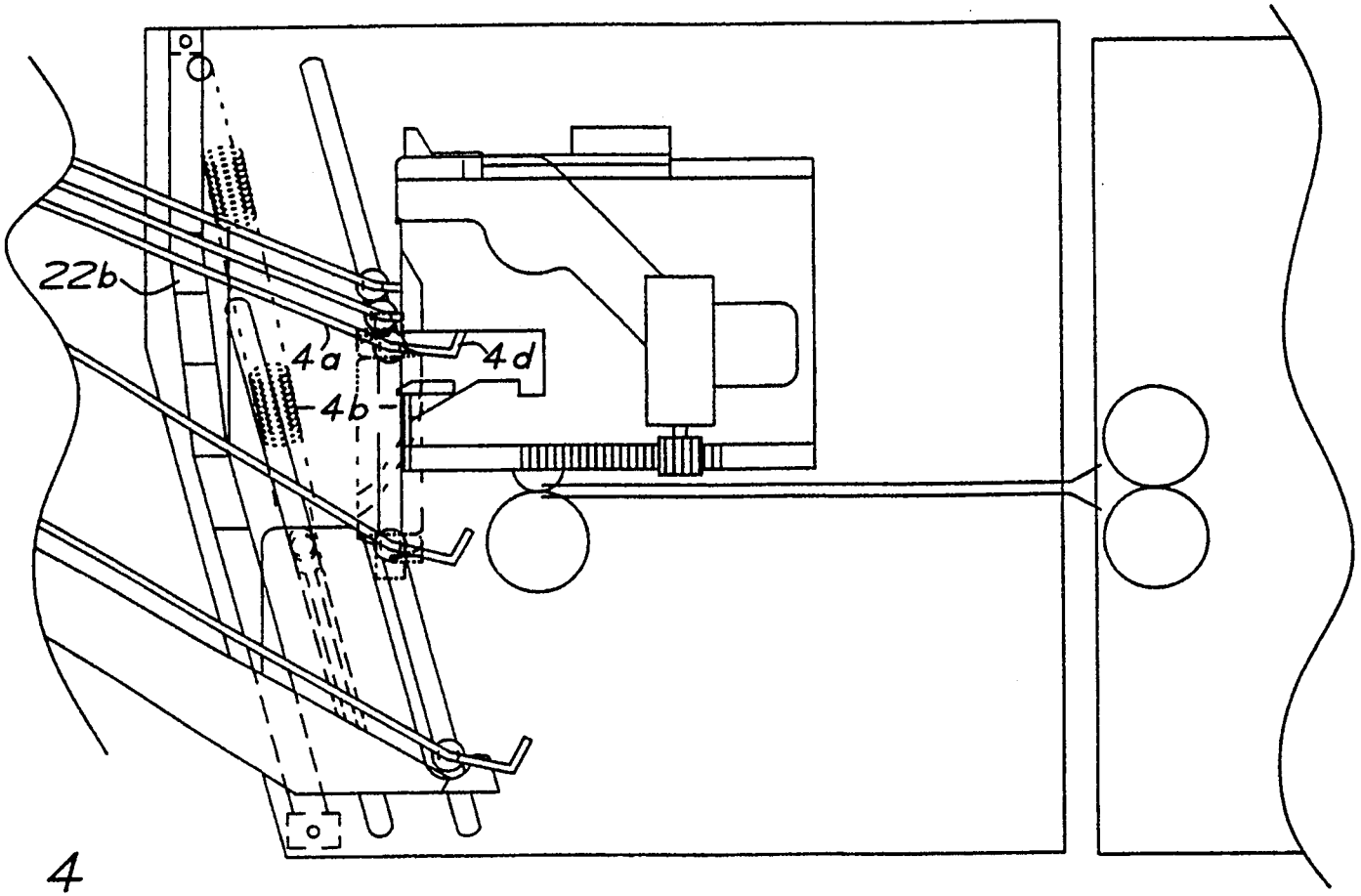
FIG. 4 is an enlarged fragmentary vertical section on the line 4—4 of FIG. 2 showing the stapling operation.

A stapler S is provided in the housing and is adapted to be shifted by a motor SM and gearing 17 between the retracted non-stapling position of FIG. 2 and the stapling position of FIG. 4.

The structure as thus far described, is well known to those skilled in the art and needs no further detailed description.

In accordance with the invention, sheet set alignment means are provided including a vertical standard or registration member 20 having a first vertical alignment surface 20*a* at one side of the trays 4 and an opposing member 21 for aligning sheets of paper in response to vertical movement of the trays. As shown, the aligning means also includes a vertically extending member 22 located at the opposite side of the trays from the registration member 20 and, in the illustrative form, extending between upper and lower support blocks 23 adjacent to the side of the trays opposite registration member 20. In the form shown, the configuration of the member 22, as will be later described, is accommodated by clearance spaces 23*a* formed in the tray. The alignment member 22 may be composed of thin plastic material or light spring steel so as to be flexible or resilient to normally assume the position of FIG. 3 and apply a light force in the direction of the registration member 20, to sheets or sets of sheets in the trays.

Figure 3:
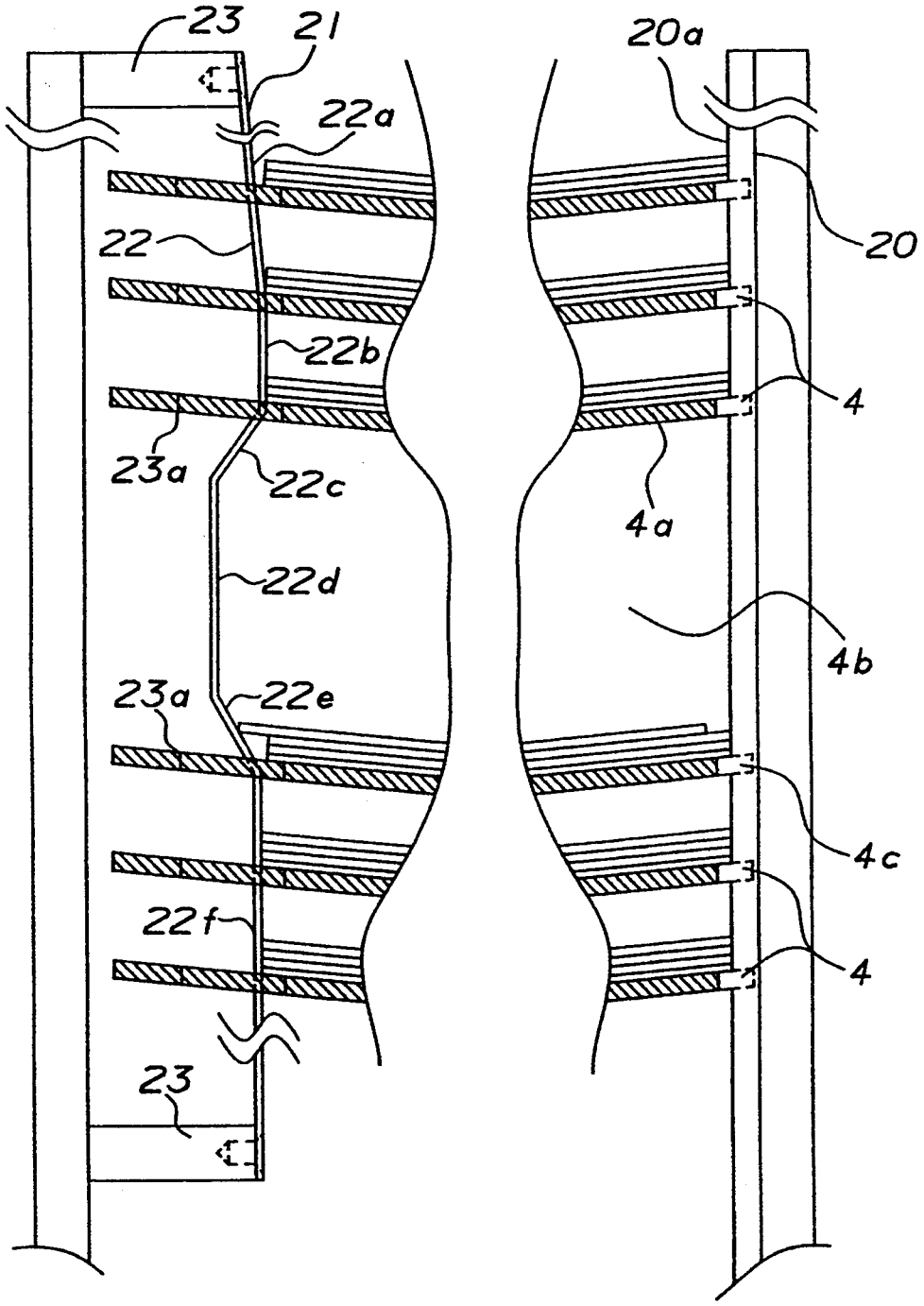
FIG. 3 is an enlarged fragmentary vertical section on the line 3—3 of FIG. 2 showing the operation of the aligning features of the sorter.

Alignment member 22 has an upper section which extends downwardly at its upper end at a slight angle has an angular face 23*a* defining with the opposing vertical surface 20*a* a converging space in which the sheets of paper in the trays 4, except for the tray designated 4*a* in FIG. 3, are not necessarily in alignment at their respective side edges because of the excess space between surface 20*a* and the portion 22*a* of the alignment member 22

As seen in FIG. 3, tray 4*a* is the first tray above the enlarged sheet entry space 4*b* defined between the tray 4*a* and the tray 4*c* next below the tray 4*a*. At this point it will be understood by those skilled in the art that the space 4*b* is determined by the vertical height of the tray shifting cams 12 described above. It will also be recognized that the sheets entering the trays from the copier or printer are fed to the trays which are successively positioned at the position of tray 4*c*, and depending upon the sheet feeding mechanisms, the last sheet to be received in tray 4*c* may be more or less out of alignment at its side edges, as illustrated by the lateral displacement of the top sheet in tray 4*c*.

The alignment member 22 below the angular section 22*a* has a vertical section 22*b* which opposes the registration surface 20*a* providing a second alignment surface at the other side of the trays in parallel relation. The vertical height of the vertical section 22*b* is such that the maximum number of sheets forming a set of sheets will be engaged between section 22*b* and the opposite parallel face 20*a*, so that sheets disposed between these parallel faces are biased into alignment along their opposite side edges.

Extending downwardly from the alignment member section 22*b* and outwardly away from the opposing face 20*a* and the sheets in the tray is a section 22*c* of the alignment member 22. This section 22*c* provides an angularly extended surface forming a wedge angle, so that as successive trays move upwardly from the position of tray 4*c* the uppermost sheet in tray 4*c* will be gently but positively moved laterally into contact with the opposing first alignment surface 20*a* of the opposing registration member 20 so that the sets of sheets in the position of tray 4*a* are moved into edge alignment between the first and second alignment surfaces 20*a* and 22*b*, as illustrated.

In addition, upon reference to FIG. 4, it will be seen that tray 4*a* is in the position in which stapling is performed and therefore stapling is performed while the sheets are in engagement between the vertical section 22*b* of alignment member 22 and the vertical face 20*a* of registration member 20. Therefore, when the staple is driven, the sheets will be confined to a neatly stacked set along their side edges, while the trailing edges of the sheets forming the set are aligned against an end flange 4*d* at the lower end of the upwardly inclined tray 4*a*.

The above functions for aligning the sheets are performed by the sections 22*a*, 22*b* and 22*c* of the alignment member 22, responsive to upward movement of the trays 4 during the sorting operations. In the downward movement of the trays during sorting operations, a similar function is performed by lower sections of the member 22. Thus, extending downwardly from the outwardly angled section 22*c* is a vertical connector section 22*d* at the lower end of which is an inclined section 22*e* extending at an angle towards the opposing face 20*a* of alignment member 20, so that as the illustrated top sheet of the set in the tray 4*c* moves downwardly with such movement of tray 4*c*, sheets will be gently urged laterally toward the vertically opposing face 20*a* so that the set of sheets in the trays below trays 4*c* are moved into neatly edge aligned sets between the further downwardly extended vertical section 22*f* of member 22 providing a third vertical surface for aligning sheets against surface 20*a* of the opposing member 20.

As the sorting operation is performed in moving bin sorters of the type here involved, it will be recognized that the sets of sheets as they are progressively increased in numbers are initially aligned by either the alignment member sections 22*c* or 22*e*, depending upon the direction of tray movement, vertically up or down relative to sheet inlet location 4*d*. Since in the illustrative embodiment the sets are stapled in the tray 4*a*, during successive downward movement of the entire group of trays which are moved to their upper most position following the sorting operation for the commencement of the stapling operations, then the sets of sheets are not only pre-aligned before stapling, but any misalignment caused by the jostling of the sheets during tray movement is corrected by the light engagement of the sheets between the vertical first surface 20*a* of the registration member 20 and a parallel vertical second surface 22*a* of the alignment member 22 when the staple is applied.

In other in-bin stapling sorters in which the sets of sheets may be stapled by a stapler adapted to operate during a different mode than the in-bin stapling sorter illustrated, the configuration of the alignment member 22 may be different provided that at the location of the stapling operation it provides the opposing parallel first surface 20*a* and a second surface like either 22*b* or 22*f* in a broad sense, or both of them in a specific sense.

Other variations and modifications of the invention may be made without departing from the scope of the invention as defined in the following claims.

We claim:

1. In an in-bin stapling sorter comprising a plurality of trays in a vertically spaced and movable stack, means for moving said trays vertically relative to a sheet infeed location to receive sets of sheets, stapling means for stapling sets of sheets in said trays, and alignment means for aligning the side edges of said sets of sheets in said trays, the improvement wherein: said alignment means includes a first registration surface extending vertically at one side of said trays and an alignment member at the other side of said trays and having a vertically extended second alignment surface vertically spaced from said sheet infeed location in one direction and parallel with said first registration surface and angularly extended surface extending from an end of said second alignment surface in a direction away from the first registration surface for moving sheets to positions between the first and second surfaces upon movement of said trays vertically in one direction relative to said first and second surfaces.

2. An in-bin stapling sorter as defined in claim 1, said alignment member being a thin flexible member applying a light lateral force to the sheets in the sets of sheets in said trays.

3. An in-bin stapling sorter as defined in claim 1, said alignment member having a third alignment surface extending vertically at said other side of said trays vertically spaced from said sheet infeed location and in the other direction vertically spaced from the second alignment surface and another angularly extended surface extending from an end of the third alignment surface and towards the second alignment surface in a direction away from said first alignment surface for moving sheets to positions between the first and third alignment surfaces upon movement of said trays vertically in the other direction relative to said first and third alignment surfaces.

4. An in-bin stapling sorter as defined in claim 3, said alignment member being a thin flexible member applying a light lateral force to the sheets in the sets of sheets in said trays.

5. An in-bin stapling sorter as defined in claim 1, said alignment member having another angularly extended surface extending from the other end of said second alignment surface at one end thereof in a direction away from said first alignment surface for moving sheets to positions between said first and second alignment surfaces upon movement of said trays vertically in the other direction.

6. An in-bin stapling sorter as defined in claim 5, said alignment member being a thin flexible member applying a light lateral force to the sheets in the sets of sheets in said trays.

7. An in-bin stapling sorter defined in claim 1, wherein said second alignment surface is above said sheet infeed location, and said stapling means is positioned for stapling sets of sheets in said trays upon movement of said trays successively downwardly to a position above said sheet inlet location.

8. An in-bin stapling sorter as defined in claim 3, wherein said second alignment surface is above said sheet infeed location and said third alignment surface is below said sheet infeed location, and said stapling means is positioned for stapling sets of sheets in said trays at one side of said sheet infeed location.

* * * * *